United States Patent [19]

Alessio

[11] 4,280,026

[45] Jul. 21, 1981

[54] ACTUATOR MECHANISM FOR A PORTABLE, HAND-HELD TOOL

[75] Inventor: Lorenzo E. Alessio, Lecco, Italy

[73] Assignee: Black & Decker Inc., Newark, Del.

[21] Appl. No.: 962,591

[22] Filed: Nov. 21, 1978

[30] Foreign Application Priority Data

Nov. 21, 1977 [IT] Italy ..... 22780/77[U]
Nov. 21, 1977 [IT] Italy ..... 22781/77[U]

[51] Int. Cl.[3] ..... H01H 15/00

[52] U.S. Cl. ..... 200/157; 200/321; 200/331

[58] Field of Search ..... 200/61.85, 153 T, 157, 200/318, 320-328, 330, 331; 74/529, 531, 532; 173/170

[56] References Cited

U.S. PATENT DOCUMENTS 3,194,084 7/1965 Filander ..... 200/157 X
4,180,716 12/1979 Suzuki ..... 200/157 X

*Primary Examiner*—Stephen Marcus
*Attorney, Agent, or Firm*—Leonard Bloom; Edward D. Murphy; Walter Ottesen

[57] ABSTRACT

The invention is directed to an actuator mechanism for controlling the operation of the motor of a portable, motor-driven tool having a housing for enclosing the motor. The actuator mechanism includes a switch actuable between off and on positions for interrupting the flow of current to the motor and for supplying current to the motor, respectively. A slider is operatively connected to the switch and slideably mounted in the wall of the housing of the tool so as to be slideable between first and second positions corresponding to the off and on positions of the switch. A resilient member resiliently urges the slider into the off position of the switch. A latch member is mounted on the slider so as to be movable with respect thereto from a latching locked-off position wherein the latch member coacts with the housing to prevent the slider from being displaced from the first position to the second position thereby locking said switch in the off position to an intermediate position in which the latch member permits manual displacement of the slider to the second position against the force of the resilient means whereby the slider returns to the first position upon manual release of the slider, and to a latching locked-on position wherein the latch member coacts with the housing to maintain the slider in second position thereby locking the switch in the on position.

14 Claims, 15 Drawing Figures

ACTUATOR MECHANISM FOR A PORTABLE, HAND-HELD TOOL

BACKGROUND OF THE INVENTION

The invention relates to actuator mechanisms for controlling the operation of the motor of a portable, hand-held tool.

It is desirable to have an actuator mechanism which can be conveniently actuated by the operator while holding the tool and which, at the same time, provides protection against the occurrence of an inadvertent or accidental start-up of the tool motor. This can be especially hazardous for power driven tools such as a grinding wheel, saw and the like. Inadvertent or accidental start-up of the tool can be prevented by providing a locked-off position for the actuator mechanism.

In addition, it is desirable for the operator to be able to intermittantly start and stop the tool while on other occasions it is preferable to be able to operate the tool without having to manually hold the actuator mechanism in the on position. This latter condition can be characterized as the locked-on position of the actuator mechanism.

Accordingly, it is an object of my invention to provide an actuator mechanism for controlling the operation of the motor of a portable tool that includes a slider and latch member which will hold the tool in the locked-off position to preclude an operator from inadvertently actuating the tool, to permit the operator to operate the tool by applying continuous pressure to the tool and, if desired, to latch the slider to place the tool in the locked-on position so that the tool will continue to operate even though the operator has released his manual hold on the slider.

It is a further object of the invention to provide an actuator mechanism which includes a slider which conforms to the contour of the housing wall of the tool. It is still another object of the invention to provide an actuator mechanism which requires a minimal number of parts and which can be easily assembled.

SUMMARY OF THE INVENTION

The actuator mechanism according to my invention is suitable for controlling portable, hand-held tools wherein the motor is an electric motor. However, the invention is easily adapted for controlling other types of motors such as air motors.

The motor of a tool is mounted in a housing and the actuator mechanism of the invention is mounted on the housing. The actuator mechanism includes a switch actuable between off and on positions for interrupting the flow of energy to the motor and for supplying energy to the motor, respectively. In the event that the motor is an air motor then the energy would be compressed air; whereas, if the motor is an electric motor, then the energy would be electric current. The actuator mechanism further includes as a feature a slider operatively connected to the switch and slideably mounted in the wall of the housing of the tool so as to be slideable between first and second positions corresponding to the off and on positions of the switch. A resilient member resiliently urges the slider into its first position. A latch member is mounted on the slider so as to be movable with respect thereto from a latching locked-off position wherein the latch member coacts with the housing to prevent the slider from being displaced from the first position to the second position thereby locking the switch in the off position to an intermediate position in which the latch member permits manual displacement of the slider to the second position against the force of the resilient means whereby the slider returns to the first position upon manual release of the slider, and to a latching locked-on position wherein the latch member coacts with the housing to maintain the slider in the second position thereby locking the switch in the on position.

According to one embodiment of the invention, an elongated seat is formed in the wall of the housing and the slider is an elongated member slideably mounted in the elongated seat. In this way, the slider substantially conforms to the contour of the wall. Thus, an actuator mechanism is realized wherein the three desirable positions are provided, namely, locked-off, intermediate, and locked-on while at the same time providing a convenient and easy to handle configuration.

In an alternate embodiment of the invention, the slider is provided with an aperture formed therein. A first latch means is formed in the housing and defines regions corresponding to respective ones of the positions of the latch member. In this embodiment the latch member is rotatively mounted on the slider and has a second latch means formed thereon so as to extend through the aperture for engaging the first latch means at selected ones of the regions.

The first latch means can be a latch opening having a substantially S-shaped configuration; and, the second latch means can be a tooth-like projection extending through the slide aperture and into the latch opening.

In the alternate embodiment, the latch member is rotatable against the resilient force of a counterspring which may be in the form of a leaf spring arranged between the latch member and the slider.

The above objects and advantages of my invention will become more apparent from a consideration of the detailed description to follow taken in conjunction with the drawing annexed hereto.

DESCRIPTION OF THE PREFERRED EMBODIMENTS OF THE INVENTION

Figure 1:
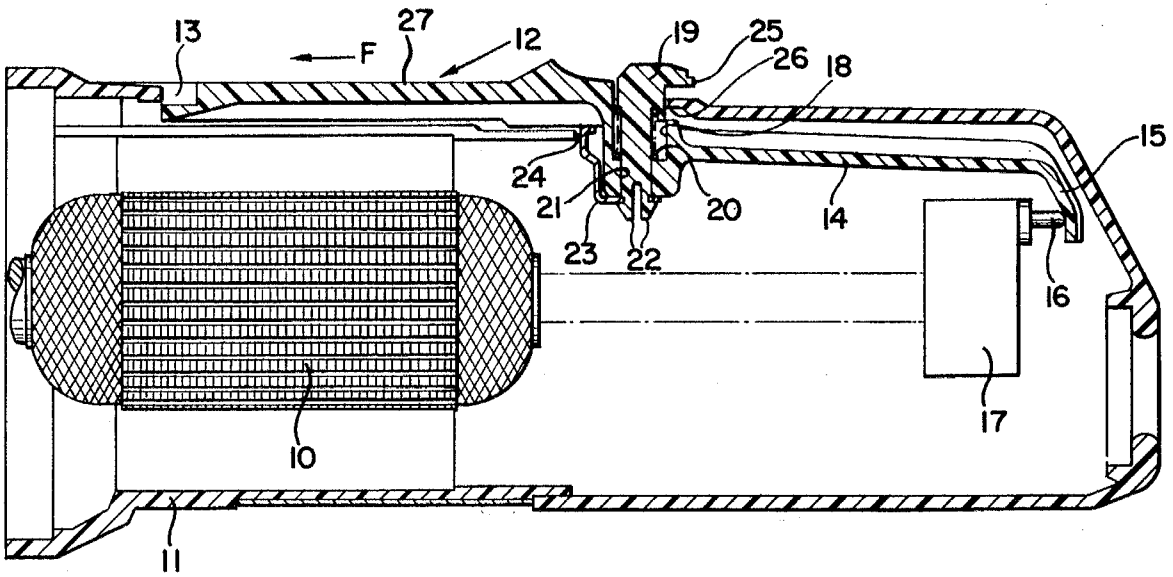
FIG. 1 is a schematic diagram, partially in section, showing the housing of a portable, hand-held electric tool equipped with the slider actuator mechanism according to the invention. The actuator mechanism is shown in its locked-off position.

Referring to FIG. 1 of the drawing, the reference numeral 10 designates an electric motor contained in a housing 11 of a hand-held, portable electric tool.

The motor 10 is energized with the aid of an actuator mechanism including a slider 12 of elongated configuration slideably mounted in elongated seat means in the form of a seat 13 of the housing 11. The elongated seat 13 guides the movement of the slider 12 in the housing 11 so that it can be moved in its longitudinal direction between first and second positions.

The slider 12 is an elongated member which includes a first elongated portion 27 slideably mounted in the seat 12 formed in the housing 11 so as to be accessible to the operator of the tool and a second elongated portion 14 which extends into the interior of the housing 11 of the tool. The second elongated portion 14 includes a downwardly bent tab for coacting with the actuator plunger 16 of a normally-open switch 17 electrically connected to the motor 10. The actuator plunger 16 is spring-loaded so as to urge the plunger 16 to the right.

FIG. 1 shows the slider 12 in its first position corresponding to the off position of the switch 17. A seat 18 is formed in the slider 12 at the mid portion thereof between the first portion 27 and the second portion 14. The seat 18 is configured to accommodate the latch member 19 which is spring-loaded in the upward direction by a spring 20.

The latch member 19 is snap-engaged in a hole 21 by means of elastic teeth 22 to which there is connected an abutment piece 23 for coacting with an abutment 24 of the housing 11. A projection 25 is formed on the latch member 19 for coacting with region 26 on the inner wall of the housing 11.

The operation of the above-described actuator mechanism will now be explained. In FIG. 1, the slider is shown in its first position corresponding to the normally-off position of the switch 17. The latch member 19 is shown in FIG. 1 in its latching locked-off position wherein the latch member 19 coacts with the housing by means of abutment piece 23 and abutment surface 24 to prevent the slider from being displaced from the first position to the second position thereby locking the switch 17 in its off position.

Figure 2:
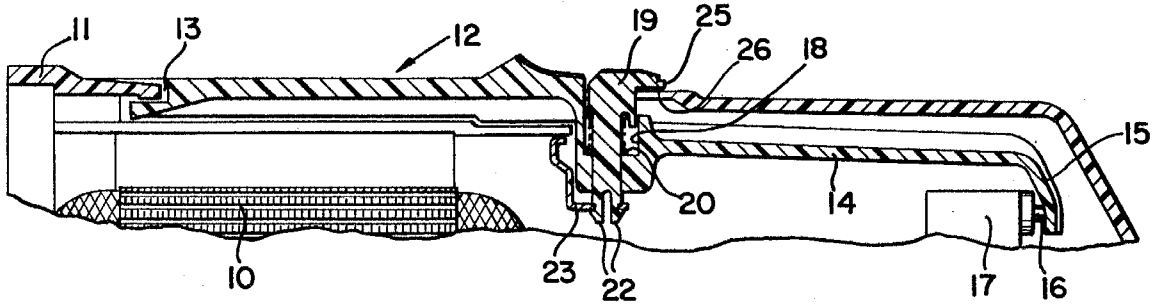
FIG. 2 illustrates the actuator mechanism in its on position.
Figure 3:
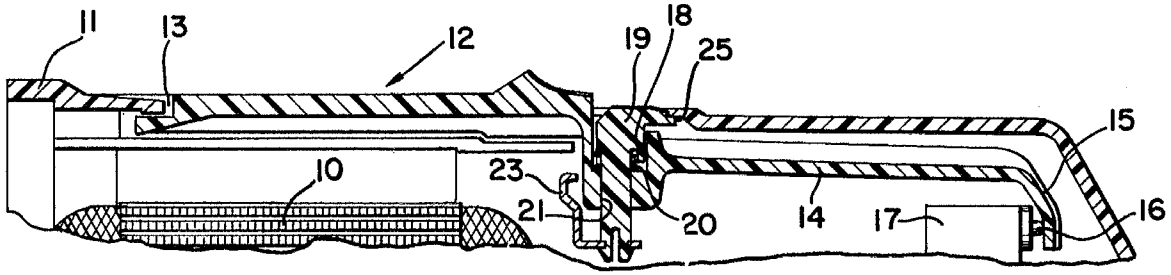
FIG. 3 shows the actuator mechanism in its locked-on position.

The motor 10 is energized by depressing first the latch member 19 and then manually pushing the slider 12 in the direction of the arrow F into the position of FIG. 2 so as to press the actuator plunger 16 of the switch 17 thereby closing the circuit to supply current to the electric motor 10. By releasing the latch member 19 and the slider 12, the resilient force of the spring-loaded plunger 16 returns the system into the position of FIG. 1. The spring-loaded plunger thus constitutes resilient means for resiliently urging the slider into its first position. On the other hand, by moving the latch member 19 from the position of FIG. 2 into that of FIG. 3, the slider 12 is prevented from returning to the position shown in FIG. 1 thereby keeping the motor in the energized condition. This is the latching locked-on position of the latch member 19.

The motor actuator mechanism of the invention can be operated with extreme ease and is provided with a safety arrangement to prevent accidental startup. Indeed, it is apparent that in the position illustrated in FIG. 1, the accidental startup of the motor is prevented by the coaction of the abutment piece 23 and the abutment surface 24 of the housing 11. More specifically, as soon as the slider 12 is urged to the left in the direction of the arrow F, the abutment piece 23 and abutment surface 24 mutually engage if the latch member 19 has not been depressed beforehand.

Figure 4:
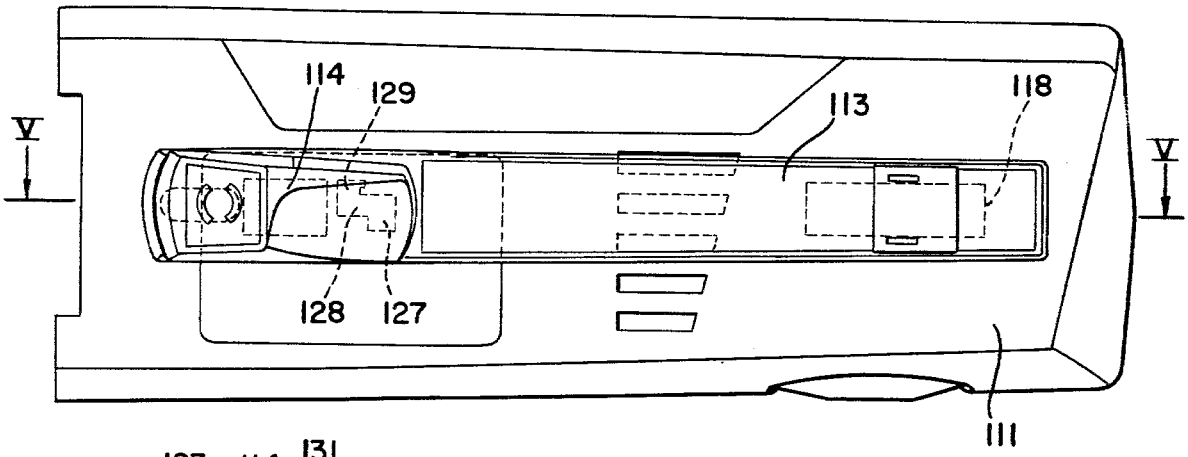
FIG. 4 is a plan view of a portable, hand-held electric tool equipped with another embodiment of the slider actuator mechanism according to the invention. The actuator mechanism is shown in its locked-off position.
Figure 5:
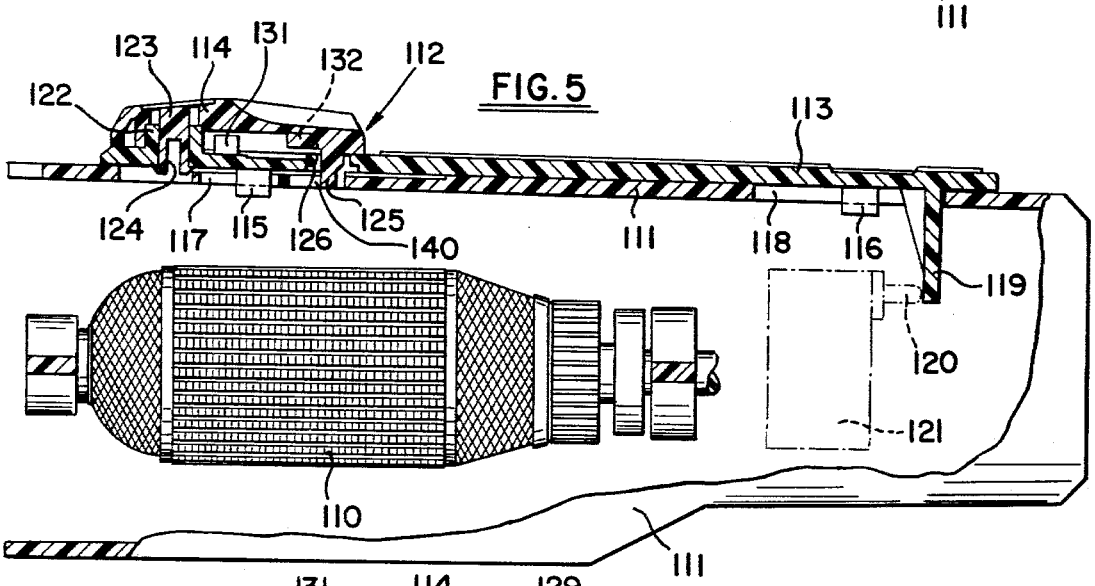
FIG. 5 is a section view taken along line V—V of FIG. 4.
Figure 6:
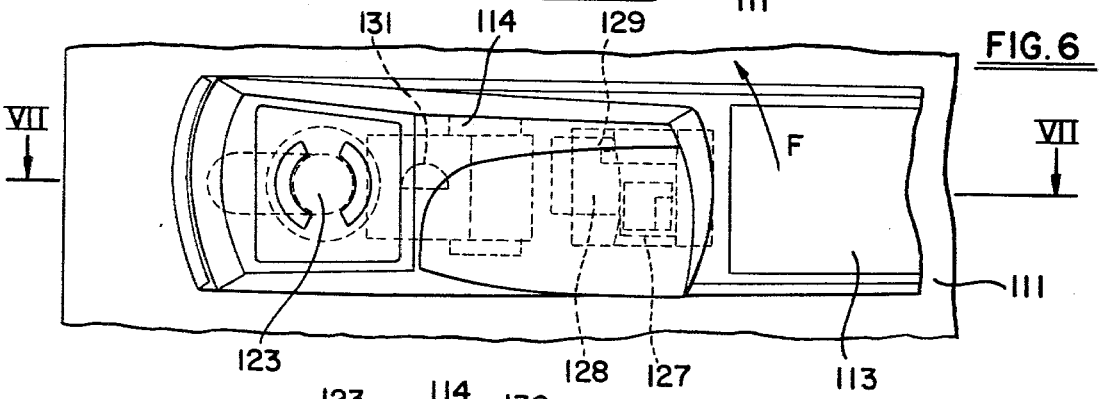
FIG. 6 is detail plan view of the actuator mechanism shown in the locked-off position.
Figure 7:
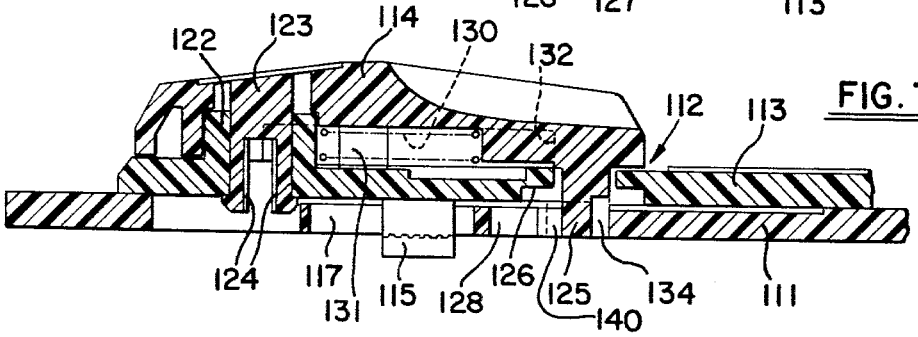
FIG. 7 is a section view of the actuator mechanism taken along line VII—VII of FIG. 6.

FIGS. 4 to 15 illustrate an alternate embodiment of the actuator mechanism according to the invention. Referring to FIGS. 4 and 5, a portable, hand-held electric tool is shown equipped with an electric motor 110 enclosed in housing 111 on which the actuator mechanism 112 is mounted.

The actuator mechanism 112 includes a slider 113 movable in a direction parallel to the longitudinal axis of the housing 111. A trigger latch member 114 is rotatably mounted on the slider 113. The slider 113 is movable between first and second positions. In FIGS. 4 to 8, the slider is shown in its first position corresponding to the off position of the switch 121.

Figure 15:
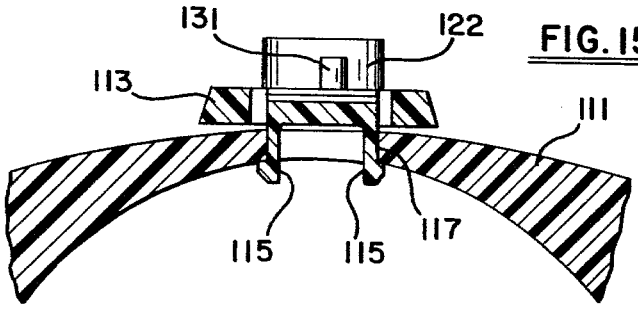
FIG. 15 is a section view taken along line XV—XV of FIG. 14.

The slider 113 has an elongated rectangular shape and is connected to the housing 111 by means of a pair of elastic retainer and guide teeth 115, 116 snap-connected within the aperture 117 of the housing 111 as shown in FIG. 15. A second pair of retainer guide teeth are snap-connected in aperture 118 (FIG. 13) of the housing 111. These snap connection means facilitate the rapid and convenient assembly of the actuator mechanism. A tab 119 extends downwardly from the slider 113 and passes through the aperture 118 to act on actuator plunger 120 of a normally-open switch 121 that is electrically connected to the motor 110.

The slider 113 has a boss 122 formed thereon onto which the trigger latch member 114 is pivotally mounted by means of a stud 123 snap-engaged therewith by means of elastic retainer teeth 124. At the left end of the trigger latch member 114 away from the stud 123, there is provided a downwardly extending locking tooth 125 that passes through an aperture 126 in the slider 113 to engage an S-shaped aperture 140 formed in the housing 111. The S-shaped aperture 140 is made up of three inter-communicating operating regions 127, 128 and 129 as shown most clearly in FIG. 13.

The counter-clockwise rotation in the direction of the arrow F (see FIG. 6) of the trigger latch member 114 is counteracted by a leaf spring 130 arranged between the slider 113 and the trigger latch member 114. The spring 130 has one end secured to a peg 131 of the slider and its opposite end is engaged in a seat 132 of the trigger latch member 114.

The operation of the actuating mechanism of my invention disclosed in FIGS. 4 to 15 will now be explained.

When the device is in the position illustrated in FIGS. 4 to 7, the motor 10 is shut off and it is impossible to start the same through accident or inadvertence. The locking tooth 125 of the trigger latch member 114 engage the slider 113 at the area 127 of the S-shaped opening 140 and it is therefore impossible to move the slider 113 toward the left out of its first position. In this condition, the trigger latch member 114 is in its latching locked-off position so that the tab 119 can not coact with plunger 120 and switch 121 to start the motor 110.

Figure 8:
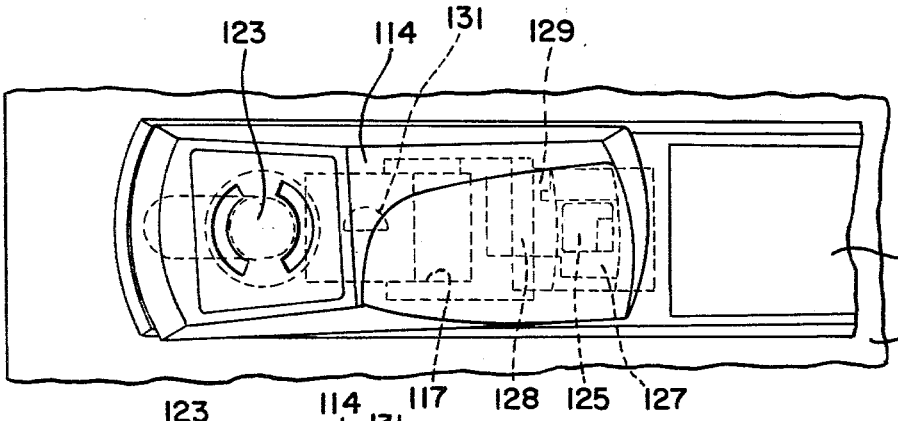
FIG. 8 is a plan view of the actuator mechanism showing the trigger latch member rotated to a position wherein a simple movement of the slider in the forward direction will actuate the motor of the tool.
Figure 9:
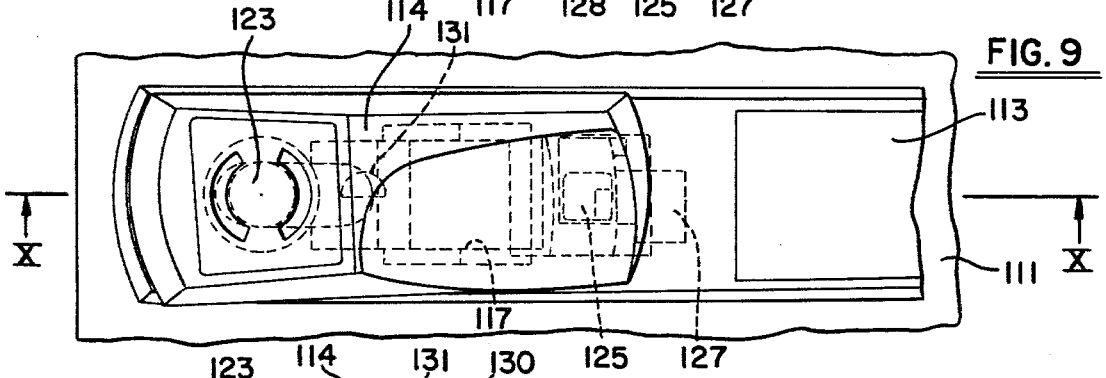
FIG. 9 is a plan view of the actuator mechanism in the on position.
Figure 10:
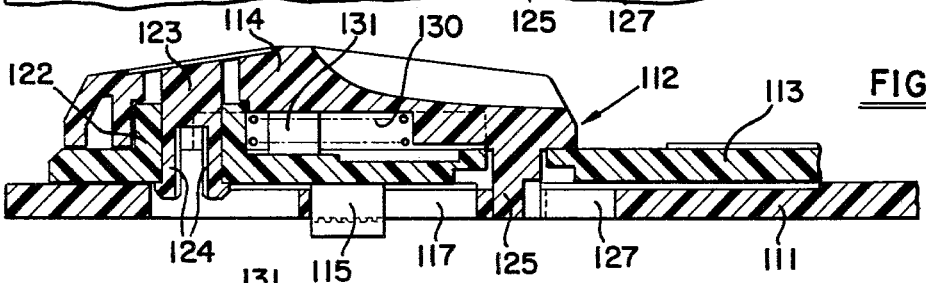
FIG. 10 is a section view of the actuator mechanism taken along the line X—X of FIG. 9.
Figure 11:
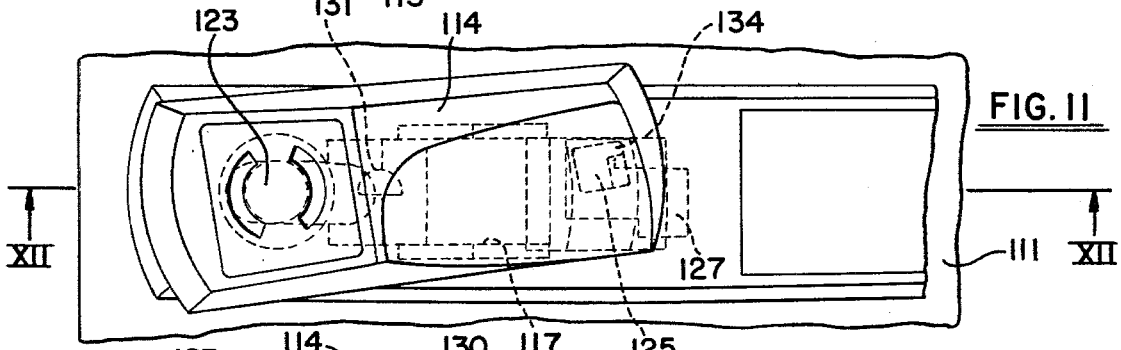
FIG. 11 is a detail plan view showing the actuator mechanism in the locked-on position.
Figure 12:
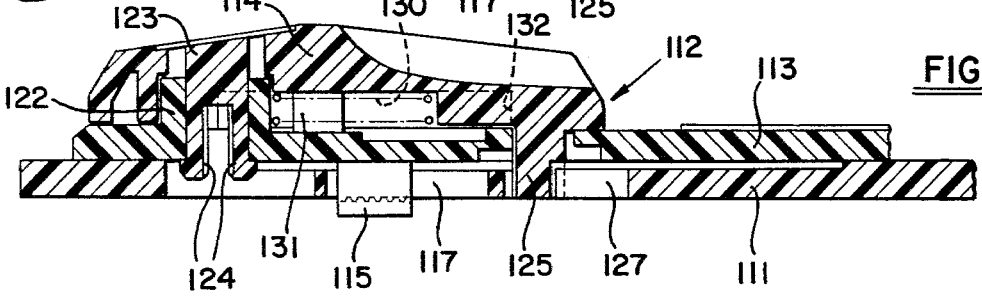
FIG. 12 is a section view of the actuator mechanism taken along the line XII—XII of FIG. 11.
Figure 13:
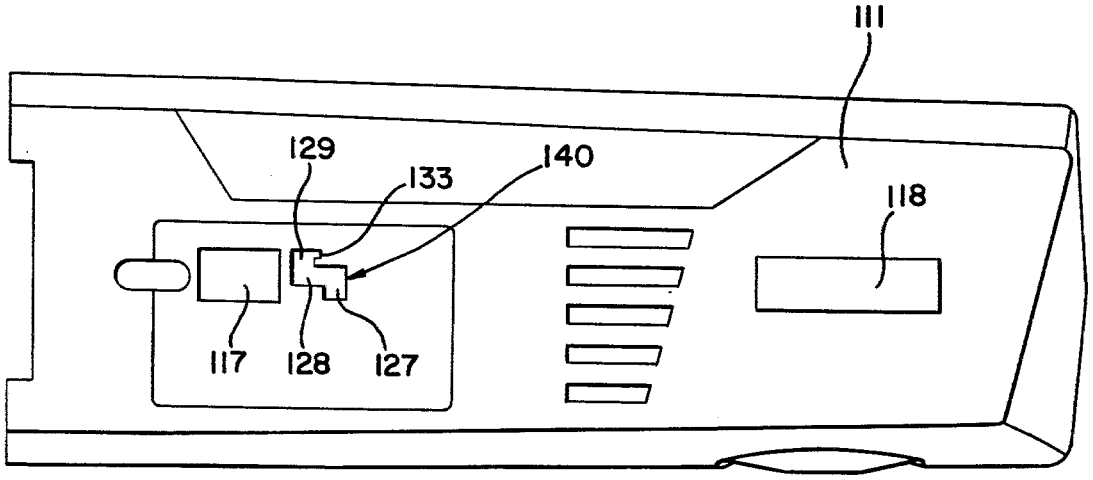
FIG. 13 is a plan view illustrating the area of the housing of the electric tool showing the openings formed therein for mounting the actuator mechanism according to the invention thereon.
Figure 14:
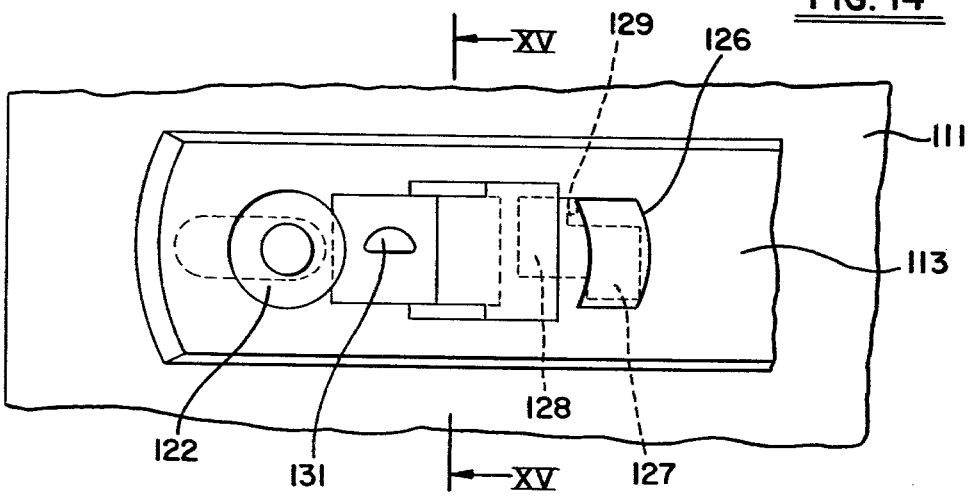
FIG. 14 is a detail plan view illustrating the assembly area of the actuator mechanism on the housing.

To start the motor 110, it is necessary to rotate the trigger latch member 114 in counter-clockwise direction into the position illustrated in FIG. 8 thereby disengaging the tooth 125 from the area 127. With the trigger latch member 114 in this angular position, it is now possible to move the slider 113 to the left thereby causing the tab 119 to coact with the plunger 120 to start the motor 110. This is the intermediate position of the trigger latch member 114 wherein the latch member permits manual displacement of the slider to its second position. Accordingly, the motor 110 can be maintained in its energized condition either by manually holding the trigger latch member 114 in the position shown in FIG. 9 against the resilient force of the spring-loaded plunger 120, or, more conveniently, by rotating the trigger latch member 114 into the position illustrated in FIGS. 11 and 12 in which its tooth 125 becomes locked in the region 129 of the opening 140. In this connection, it should be noted that the area 129 is provided for this purpose with a latch opening 133 which engages a corresponding projection 134 of the tooth 125 as shown in FIG. 11. This is the latching locked-on position of the trigger latch member 114.

To stop the motor 110, all that is necessary is to push the trigger latch member 114 forward so as to disengage the projection 134 from the narrow opening 133; at this point, by releasing the trigger latch member 114, the combined action of the spring 130 and of the spring-loaded plunger 120 returns the system into its rest and safety state illustrated in 4 to 7 whereat the switch 121 is again in its normally-off position and the motor 10 is disconnected.

While there has been illustrated and described two possible embodiments of my invention, it will be understood that variants and modifications can be made thereof without thereby departing from the scope of the invention itself as defined by the claims that follow.

What I claim is:

1. An actuator mechanism for controlling the operation of the motor of a portable, motor-driven tool having a housing for enclosing the motor, the actuator mechanism comprising:

a switch having an actuating plunger movable between first and second positions corresponding to the off and on conditions of said switch, said actuating plunger being spring-loaded to normally maintain said switch in said off condition, a slider engaging said plunger and slideably mounted in the wall of the housing of the tool so as to be slideable against the resilient force of said plunger between first and second locations corresponding to the off and on conditions of said switch;

a latch member mounted on the slider so as to be movable with respect thereto from a latching locked-off position wherein said latch member coacts with said housing to prevent the slider from being displaced from said first location to said second location thereby locking said switch in said off condition to an intermediate position in which said latch member permits manual displacement of said slider to said second location against the force of said spring-loaded plunger whereby said slider returns to said first location upon manual release of said slider, and to a latching locked-on position wherein said latch member coacts with said housing to maintain said slider in said second location thereby locking said switch in said on condition.

2. The actuator mechanism of claim 1 comprising: elongated seat means formed in said wall of said housing; and, said slider being an elongated member and slideably mounted in said seat means to substantially conform to the contour of said wall.

3. The actuator mechanism of claims 1 or 2 comprising: a latch spring for spring-loading said latch member into its locked-off position; a catch formed on said housing for catching said latch member in said locked-on position whereby said latch spring holds said latch member against said catch in said locked-on position.

4. The actuator mechanism of claim 2, said elongated slider including: a first elongated portion slideably seated in said seat means so as to be accessible for manual operation, and a second elongated portion within said housing and operatively connected to said switch.

5. An actuator mechanism for controlling the operation of the motor of a portable, motor-driven tool having a housing for enclosing the motor, the actuator mechanism comprising:

a switch actuable between off and on positions for interrupting the flow of energy to the motor and for supplying energy to the motor, respectively;

a slider operatively connected to said switch and slideably mounted in the wall of the housing of the tool so as to be slideable between first and second positions corresponding to the off and on positions of said switch;

resilient means for resiliently urging said slider into said first position;

a latch member mounted on the slider so as to be movable with respect thereto from a latching locked-off position wherein said latch member coacts with said housing to prevent the slider from being displaced from said first position to said second position thereby locking said switch in said off position to an intermediate position in which said latch member permits manual displacement of said slider to said second position against the force of said resilient means whereby said slider returns to said first position upon manual release of said slider, and to a latching locked-on position wherein said latch member coacts with said housing to maintain said slider in said second position thereby locking said switch in said on position;

said slider having an aperture formed therein;

first latch means formed in said housing and defining regions corresponding to respective ones of said positions of said latch member; and, said latch member being rotatively mounted on said slider and having second latch means formed thereon so as to extend through said slider opening for engaging said first latch means at selected ones of said regions.

6. The actuator mechanism of claim 5, said first latch means being a latch opening having a substantially S-shaped configuration; and, said second latch means being a projection extending through said aperture and into said latch opening.

7. The actuator mechanism of claim 6 comprising: spring means disposed between said latch member and said slider for biasing said latch member into said locked-off position.

8. The actuator mechanism of claim 5, 6 or 7, said switch including a plunger operatively connected to said slider, said resilient means being a spring for urging said plunger into said off position and into contact with said slider.

9. The actuator mechanism of claim 8, said slider having a downwardly extending tab formed thereon for receiving the resilient force of said plunger.

10. The actuator mechanism of claim 5 or 6 comprising: first snap retainer means for slideably holding said slider on said housing.

11. The actuator mechanism of claim 10 comprising: second snap retainer means for rotatably holding said latch member on said slider.

12. The actuator mechanism of claim 5 comprising: spring means disposed between said latch member and said slider for biasing said latch member into said locked-off position.

13. The actuator mechanism of claim 12, said switch including a plunger operatively connected to said slider, said resilient means being a spring for urging said plunger into said off position and into contact with said slider.

14. The actuator mechanism of claim 13, said slider having a downwardly extending tab formed thereon for receiving the resilient force of said plunger.

* * * * *